US005581818A

United States Patent [19]

Lorenzi et al.

[11] Patent Number: 5,581,818

[45] Date of Patent: Dec. 10, 1996

[54] PROTECTIVE HEAD COVERING

[76] Inventors: Roy J. Lorenzi; Starr L. Lorenzi, both of 27133 Kindlewood La., Bonita Springs, Fla. 33923

[21] Appl. No.: 528,116

[22] Filed: Sep. 14, 1995

[51] Int. Cl.[6] ..... A42B 3/00

[52] U.S. Cl. ..... 2/411; 2/425

[58] Field of Search ..... 2/410, 411, 412, 2/413, 414, 425, 205, 195.7, 195.8, 171, 417

[56] References Cited

U.S. PATENT DOCUMENTS

| | | | |
|---|---|---|---|
| 1,080,690 | 12/1913 | Hipkiss | 2/412 |
| 1,675,864 | 7/1928 | Pekowski . | |
| 2,445,209 | 7/1948 | Clark . | |
| 2,717,384 | 9/1955 | Frothingham . | |
| 2,763,005 | 9/1956 | Richter | 2/414 |
| 3,286,275 | 11/1966 | Marchello | 2/411 |
| 3,350,718 | 11/1967 | Webb | 2/414 |
| 3,457,563 | 7/1969 | Marchello | 2/414 |
| 3,467,964 | 9/1969 | Hannan | 2/410 |
| 4,075,717 | 2/1978 | Lemelson | 2/412 |
| 4,581,773 | 4/1986 | Cunnane | 2/204 |
| 4,646,367 | 3/1987 | El Hassen et al. | 2/411 |
| 5,025,504 | 6/1991 | Benston et al. | 2/181.4 |
| 5,031,246 | 7/1991 | Kronenberger | 2/181 |
| 5,269,026 | 12/1993 | McManus | 2/414 |
| 5,289,591 | 3/1994 | Andersen | 2/411 |
| 5,461,730 | 10/1995 | Carrington | 2/411 |

*Primary Examiner*—Michael A. Neas

[57] ABSTRACT

Disclosed is a protective head covering to be worn mostly while skiing. In this particular sport many falls and or spills occur which can be quite hurtful to the head of a skier, especially to the back of the head where many injuries are sustained. The head covering consists of an inner head contacting portion having an elastic strap placed thereon which will retain an impact absorbing pad. The pad is made of an open cell material and is shaped in the form of a crescent to thereby extend over the head of a wearer from substantially the forehead to the lower margin of the cranium at the back of the head of a wearer. The impact absorbing pad has a predetermined thickness and also extends widthwise across the head to its sides. The inner head contacting portion and the outer crown portion are made of a unitary piece of a material and they have a mutual margin in the form of a fold at a lower edge of the head covering. The two portions could also be made of two different materials that are joined to each other at the lower edge of the head covering and will form a fold at that location.

16 Claims, 4 Drawing Sheets

PROTECTIVE HEAD COVERING

BACKGROUND OF THE INVENTION

The invention is concerned with a protective head covering to be worn while enjoying the sport of skiing. When skiing, one often falls due to the slippery surface one is skiing on and also due to the unpredictable topography ahead of one's course. It is also clear that varying levels of skill are involved when skiing. The problem is, when skiing, that a number of falls or spills occur that can hardly be prevented. These falls can be quite hurtful, particularly on a well traveled run where the snow has compacted. These falls or spills can lead to severe injuries particularly to the head of a skier and more particularly to the back of the head because many falls are occurring in this manner.

Therefore, it is desirable to wear a protective head covering while skiing. Many protective head coverings are known in various sports such as football, racquet ball, boxing, karate, while riding bicycles, motor-cycles, skateboards, roller-skates or while roller-blading. However, all of these protective head coverings do not lend themselves very well while skiing because they are heavy, cumbersome and will obscure the vision of a skier. A skier needs a freedom of head movements for quickly evaluating a developing situation or for aiding in the person's balance. Therefore, effective head protective head coverings for skiers have not been developed and are not known.

Skiers wear knitted hat coverings that can assume various positions on the head, that is, higher up or pulled farther down including over the ears. A knitted brim can be attached to the lower portion of the knitted hat or the crown and be pulled up to thereby function as a head band or it can be pulled down over the ears. There are other known head coverings for skiers in the form of a baseball cap with a visor up front and flaps on the sides that can be pulled down over the ears or the flaps will extend all the way around the back of the head and function as a brim either up or down. While all of the above named head coverings protect against the cold, they are not capable of protecting against impacts to the head when falls or spills occur.

Therefore, an object of the invention is to create a head covering for skiers that accomplishes both, a protection against the cold as well as a protection against impacts to the head. The head covering of the invention will appear to the observer as the here-to-for known head covering including a fashionable appearance without realizing the presence of the secondary function. It is further emphasized that no hard or rigid parts are being used in the head covering of the invention. All the components or portions that are being used are made of pliable materials including the impact absorbing pad which is form retaining but still is flexible enough to conform to the shape of a head of a user without creating any discomforts. As a matter of fact, the presence of the pad can hardly be felt.

U.S. Pat. No. 4,581,773 shows a head covering having been made of all pliable materials. However, it is quite different from the invention at hand in that the crown itself is made as a shell with impact absorbing pads placed therein.

U.S. Pat. Nos. 2,717384, 5,025,504, 5,269,026 and 5,289,591 all show head coverings that to a casual observer do not indicate that they also serve a secondary function of protecting the head of a wearer against impacts. However, in all of these prior art hats or head coverings this is accomplished by merely placing a hard liner or a cushion underneath the crown portion.

U.S. Pat. Nos. 1,675,846, 2,445,209, 4,646,367 and 5,031,246 all are concerned with placing a cushion or an impact resisting pad within their respective headbands around the head. This is not the object of the invention at hand.

DETAILED DESCRIPTION OF THE DRAWINGS.

Figure 1:
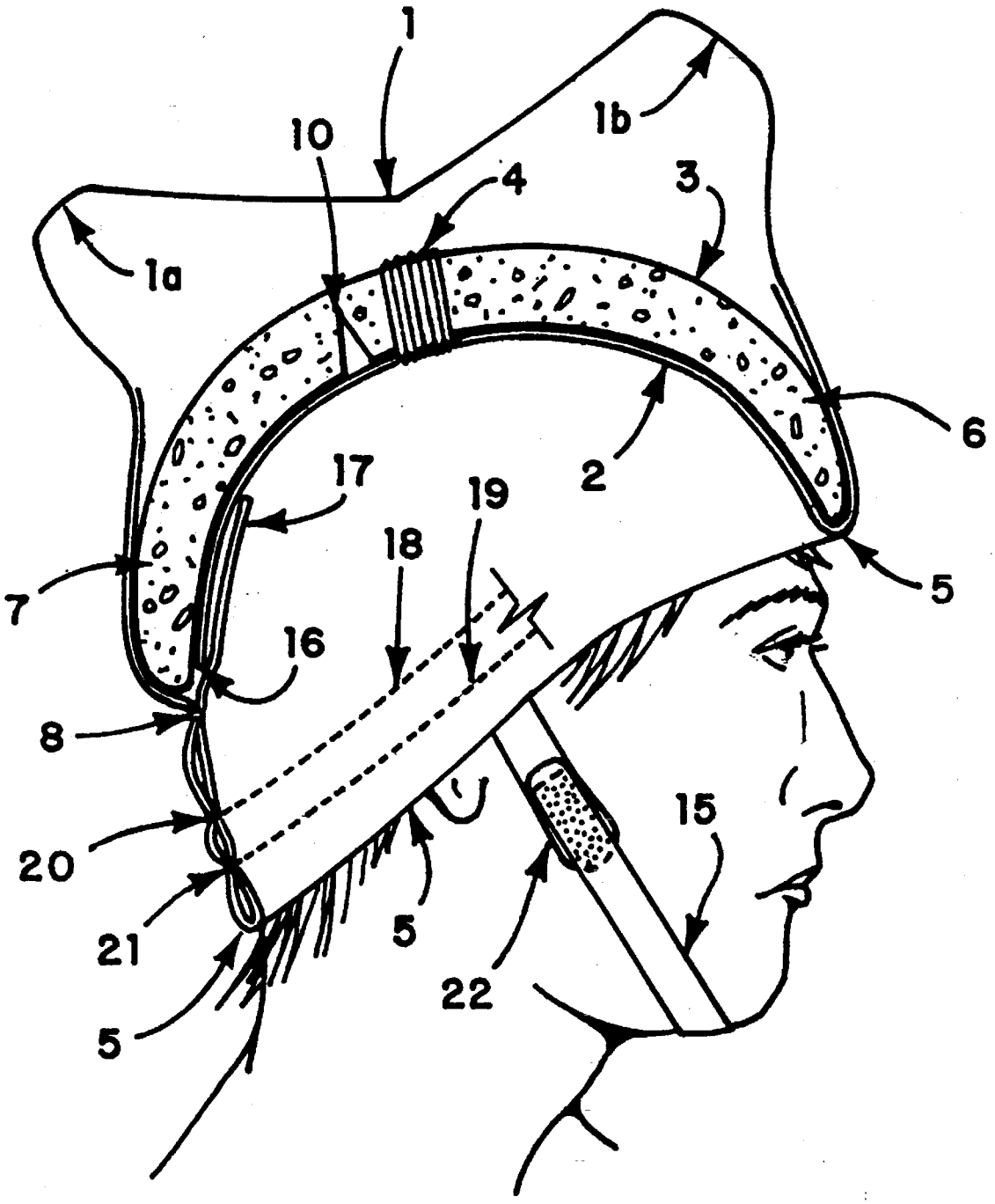
FIG. 1 is a side-view of the protective head covering partially broken away.

In FIG. 1, the outer crown portion is shown as 1 and it can take various forms as will be explained later and is always seen by other observers. In most shapes, that it can take, it most always is distended from the head of a wearer and the impact absorbing pad 3 is located below the same. The inner head contacting portion is identified as 2 and retains the impact absorbing pad 3 on top of itself but below the outer crown portion 1. The outer crown portion 1 and the inner head contacting portion 2 are assembled from one unitary piece of material as is shown in FIG. 3. The pattern shown in this FIG. shows two half rounded edges 2*a* and 2*b* and two irregular edges 1*a*and 1*b*. The pattern, when transposed onto a piece of pliable material is sewn or assembled in the following manner: The two irregular edges 1*a* and 1*b* and the two side edges 1*c* and 1*d* are all sewn to each other to thereby form a hollow structure. Thereafter, the two edges 2*a* and two 2*b* are sewn together and the two side seams 2*c* and 2*d* are partially sewn two each other in order to leave a somewhat open seam, the purpose of which will be explained later. However another hollow structure has been formed which now will be inverted and pushed into the first hollow structure and as a result a fold line 5 is formed as identified in FIGS. 1 and 2. Therefore, it can be seen, that the outer crown portion and the inner head contacting portion have a mutual margin where they meet at the lower edge or the fold line 5. Referring back to FIG. 1, the pad is shown as it is positioned on the head of the wearer and how it is retained in this position. The forward edge 6 of the pad is retained against a forward movement by being placed within the fold line 5 and in contact therewith. This position is substantially at the forehead of the wearer when the head covering is being donned. This is substantially identical to all known knitted hats that skiers wear. The rearward edge 7 of the pad is retained in the vicinity of the edge of the cranium of the wearer while the head covering itself continues to about the neck area of the wearer as is also customary and known when knitted hats are worn. In order to retain the rear-ward edge 7 of the pad at the above noted position, at least one bartack 8 is placed at that position which will penetrate through both material portions to thereby form an effective barrier for any downward movement of the pad when placed on the head of the wearer.

The partially finished seam 2*c*/2*d* will now be explained in more detail. Just prior to closing this seam, the inner head contacting portion is inverted one more time so that a lateral strap 4 can be attached to the top of the inner portion. The lateral strap is long enough to span the impact absorbing pad in a lateral extent, that is, lateral or normal to the longitudinal direction of the pad. The longitudinal direction being the pad extending from the forehead to the rear of the wearer of the head covering. Again, just prior to closing this seam, the pad is placed through the unfinished seam onto the top of the inner head contacting portion and under the strap 4. It should be noted that the strap is preferably made of an elastic material because it will snugly hold the pad against the inner head covering and will facilitate the insertion of the pad under the strap and thereby the pad is being retained against any lateral movements when the head covering is being worn. 0f course, while the pad is being inserted, the forward edge 6 of the pad is placed against the fold 5 and the rear-ward edge 7 is placed against the bartack 8 at the rear of the head. In this manner, the head covering is retained on the head of a wearer in a most effective manner. The unfinished seam can now be finished to complete the assembly. Instead of finishing the seam, a separable fastener can be included at this location, such as overlapping pieces of fabrics as shown in FIG. 1 at 16 and 17 or a slide fastener or a hook and loop-type fastener. This will enable a user to easily remove the impact absorbing pad when the head covering is being washed and then dried in a hot air dryer to avoid any damage to the same.

Once the head covering is fully assembled, a further modification can be made to enhance the appearance of the head covering and that is to place one or two seams 18 and 19, as seen in FIG. 1, inwardly from the lower edge of the head covering. This takes on the appearance of a brim portion at this location which could be moved up or down which is well known. The two seams which are passing through the material of both portions are also shown at 20 and 21. When placing these seams, it should be noted that the same appearance as at 20 and 21 will also appear in the same manner at the front of the head covering. the innermost seam 18 will then act as the forward retaining means for the forward edge of the pad. That is, somewhat inwardly from the lowest edge or the fold of material.

In order to avoid the head covering from being dislodged from the head of a wearer, a chinstrap 15 may be included having a separable fastener therein as shown at 22.

Figure 3C:
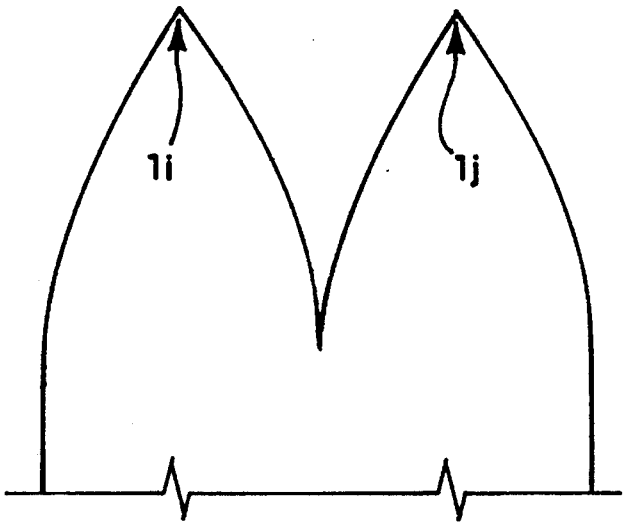
FIGS. 3*a* to 3*c* show variations of the basic pattern.
Figure 3B:
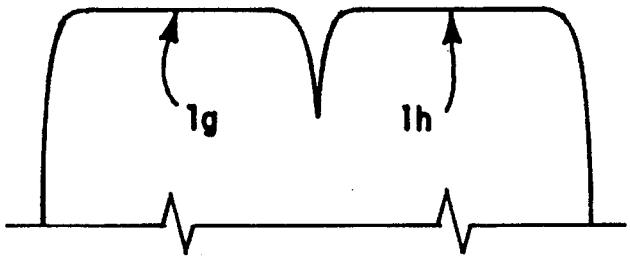
Figure 3A:
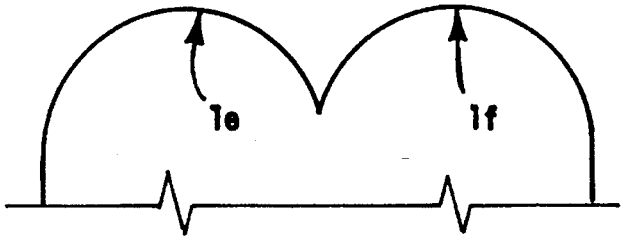

Returning now to FIGS. 3 and 3*a*–3*c*, various modifications may be made which do not change the function of the head covering at all, but will create different fashion statements. Therefore, when combining seams 1*a* and 1*b* in FIG. 3, two pointed peaks are created which can be combined at their peaks with a tassle thereat or simply left alone. When sewing together seams 1*e* and 1*f* in FIG. 3*a*, one obtains the appearance of a regular hat. When sewing together seams 1*g* and 1*h* of FIG. 3*b*, one obtains the appearance of a fez-type hat and when sewing together the seams 1*i* and 1*j* of FIG. 3*c*, one obtains a head covering having one long peak as is found in night hats, for example, having a singular tassle thereon. Many other and different combinations are possible and can be envisioned. In FIG. 3, line 5 represents a fold line, while FIGS. 18 and 19 represent stitch lines as explained above.

The unitary piece of material as shown in FIG. 3 could also be made of two different materials which would be joined at their lower edges or at the fold line 5. Even in this embodiment, they still would have mutual margins at that edge. The materials envisioned to be used could be knitted, woven or non-woven materials of various compositions. Materials that could be used for the inner head contacting portions should be chosen to be pleasing in a tactile manner because they are in contact with the head of a user and materials for the outer crown portion should be chosen having the environment and resistance to inclement weather in mind.

Figure 2:
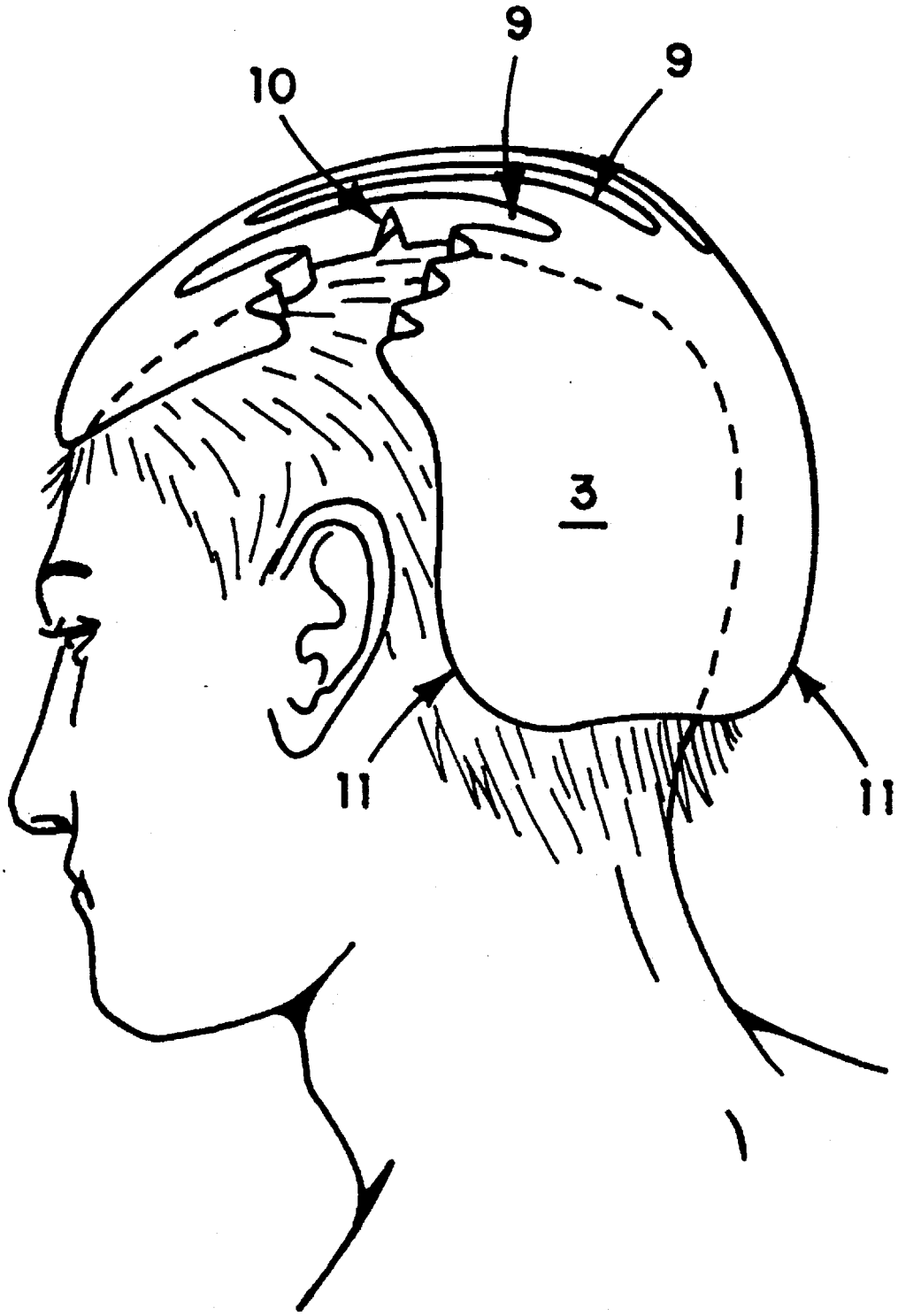
FIG. 2 is perspective view of the impact absorbing pad and how it conforms to the head of a wearer.
Figure 3:
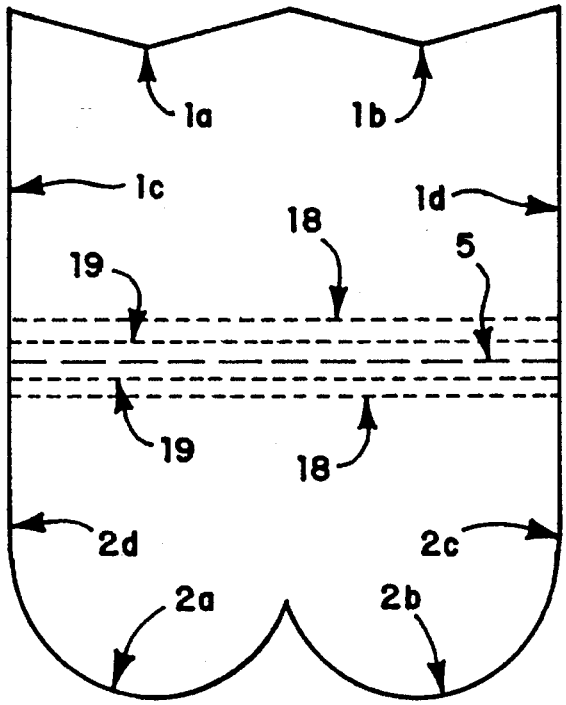
FIG. 3 shows the pattern laid out flat from which the head covering is assembled.

Attention is now directed to the impact resistant pad itself as shown in FIGS. 1 and 2. As shown in FIG. 1, the pad has the shape of a sickle to conform to the shape of a head of a wearer. It is preferably made of an open-cell material because it will remain light weight and resilient. The air entrapped within the pad simply is being compressed at the point of impact and springs back to its original shape thereafter. Preferably, ventilation perforations 9 are placed through the thickness of the pad and these perforations are preferably placed at the top of the pad only for the purpose of maintaining a maximum impact effectiveness at the rear of the head of a wearer. As shown in FIG. 2, the perforations are shown as elongated openings 9 through the material, however, these openings do not have to be elongated but could take on geometric forms such as circles, squares, triangles, etc. It is also preferred that pie-shaped cut outs 10 be placed on the underside of the pad, that is, the side facing the head of wearer. These cut outs 10 will accommodate various head sizes because they simply will expand or contract according to different head sizes without creating any stresses in the material of the pad itself. The rear section of the pad is preferably enlarged into a dovetail shape as shown in FIG. 2 at 11. As mentioned above, many falls experienced by skiers are backward falls and by having more material at the back of the head, injuries to this area of the head are greatly reduced.

Figure 4:
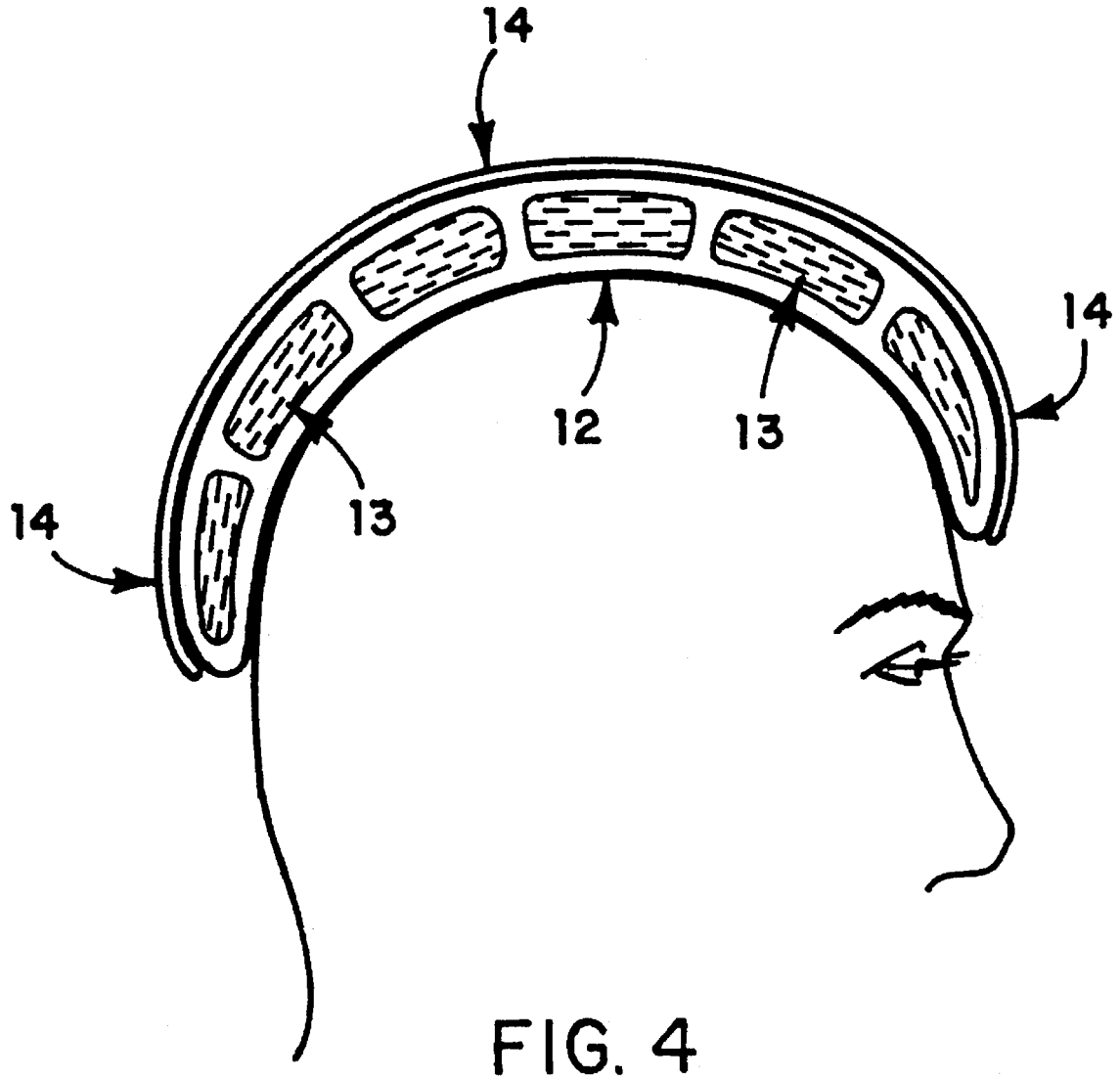
FIG. 4 shows a different construction of the impact absorbing pad.

FIG. 4 shows the construction of a different pad. The pad 12 is shown in cross-section and is constructed as a bladder having an impact absorbing jell therein. In order to be most effective, the bladder should be subdivided into a multiple of compartments 13 so that any impacts occurring in a particular area are resisted at a localized area instead of being dissipated over the total volume of the bladder.

Still referring to FIG. 4, 14 indicates a layer a semi-rigid but still flexible plastic which is superimposed over the impact resistant pad 13. When using such a layer, any impacts occurring anywhere on top or on the back of the head of a user are spread over a wider area and are easier to absorb than having to be absorbed in a localized area. It is pointed out that the layer 14 of a plastic material could also be added to the pad 3 shown in FIGS. 1 and 2 with the same results as enumerated when placing the layer 14 on pad 13 of FIG. 4.

What we claim is:

1. A Protective head covering consisting of an outer crown portion and an inner head contacting portion having an impact absorbing pad attached thereto, said pad having a three-dimensional shape in the form of a crescent and conforming substantially to the shape of the head of a wearer in a longitudinal direction and extending substantially with a forward edge from the forehead of a wearer to an edge of the cranium of a wearer with a rear-ward edge at the back of the head, said pad having a predetermined thickness and further having a width substantially covering the head of a wearer in a width-wise direction normal to said longitudinal direction, said inner head contacting portion includes means for retaining said pad on said inner head contacting portion, said retaining means includes strap means for spanning said pad in a width-wise direction, said outer crown portion and said inner head contacting portion having a mutual margin at a lower edge of said head covering, said retaining means further comprising said forward edge of said pad being in contact with said mutual margin while said rear-ward edge of said pad is in contact with a stop placed inwardly of said mutual margin and through both said outer crown portion and said inner head contacting portion, said outer crown portion and said inner head contacting portion both being made of pliable material.

2. The head covering of claim 1, wherein said pad is constructed of an open cell material.

3. The head covering of claim 1, wherein said pad has perforations through its thickness to ventilate the head of a wearer.

4. The head covering of claim 3, wherein said perforations are located in said pad only at the top of a wearer's head.

5. The head covering of claim 2, wherein at least one pie-shaped cut is placed into said pad at its side facing the head of a wearer to allow said pad to adjust itself from a small size to a larger size without creating stresses in said material.

6. The head covering of claim 2, wherein said pad is widened into a dove-tail shape at its location at the back of the head of a wearer.

7. The head covering of claim 1, wherein said pad is constructed as a bladder and has an impact absorbing jell located therein.

8. The head covering of claim 7, wherein said bladder is constructed having multiple compartments therein.

9. The head covering of claim 1, wherein said outer crown portion and said inner head contacting portion are made of one unitary piece of material.

10. The head covering of claim 9, wherein there is a fold between said portions, said fold is placed at the lower edge of said head covering constituting said mutual margins.

11. The head covering of claim 1, wherein said outer crown portion is made of one material and said inner head contacting portion is made of a different material, said materials being joined together at said lower edge.

12. The head covering of claim 1, wherein said strap means is made of an elastic.

13. The head covering of claim 1, including a means for retaining said head covering on the head of a wearer.

14. The head covering of claim 1, including a separable fastening means in said inner head contacting means for allowing said pad to be removed from said head covering.

15. The head covering of claim 1, wherein a semi-rigid but flexible layer is attached on top of said pad.

16. The head covering of claim 1, including at least one seam being placed inwardly of said lower edge and through both material portions.

* * * * *